United States Patent [19]

Focke et al.

[11] Patent Number: 4,949,841

[45] Date of Patent: Aug. 21, 1990

[54] CIGARETTE PACK, ESPECIALLY HINGE-LID PACK

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 318,395

[22] Filed: Mar. 3, 1989

[30] Foreign Application Priority Data

Mar. 3, 1988 [DE] Fed. Rep. of Germany ..... 3806819

[51] Int. Cl.[5] ..... B65D 85/10; A24F 15/16

[52] U.S. Cl. ..... 206/254; 206/273; 229/87.05; 229/87.13

[58] Field of Search ..... 206/250, 249, 273, 804, 206/271, 268, 620, 254, 255; 229/87 C

[56] References Cited

U.S. PATENT DOCUMENTS

| | | | |
|---|---|---|---|
| 200,954 | 6/1920 | Gunn | 206/273 |
| 381,889 | 4/1988 | Scott | 206/804 |
| 1,144,559 | 6/1915 | Mendelson et al. | 206/804 |
| 1,586,248 | 6/1924 | Komura | 206/804 |
| 2,129,887 | 9/1938 | Tamarin | 206/250 |
| 2,522,061 | 3/1948 | Rioux | 206/250 |
| 2,812,057 | 11/1957 | Brownfield | 206/250 |
| 2,984,384 | 5/1961 | Chalmers et al. | 229/87 C |
| 3,260,405 | 7/1966 | Frischer et al. | 206/804 |
| 4,119,196 | 10/1978 | Flaherty . | |
| 4,664,310 | 12/1987 | Egon . | |

FOREIGN PATENT DOCUMENTS

| | | |
|---|---|---|
| 1009103 | 10/1953 | Fed. Rep. of Germany . |
| 0831203 | 12/1937 | France . |

*Primary Examiner*—Paul T. Sewell
*Assistant Examiner*—Jacob K. Ackun, Jr.
*Attorney, Agent, or Firm*—Sughrue, Mion, Zinn, Macpeak & Seas

[57] ABSTRACT

2.1 Hinge-lid packs made of thin cardboard and consisting of a pack part (12) and hinge-lid (13) present certain difficulties in gaining access to the closely packed cigarettes when the pack is to be used, even after a flap (30) as part of an inner blank (18) has been pulled off.

2.2 To make it easier to extract cigarettes, part of the inner blank (18), particularly its front wall (20), is lifted by being pulled upwards, so that a row (front row 34) of cigarettes (10) is likewise lifted relative to the remaining ones. It thus becomes easier to extract them.

To make it easier to lift the front wall (20), a gripping tab (42) of the front wall (20) is exposed when the flap (30) is pulled off.

5 Claims, 4 Drawing Sheets

CIGARETTE PACK, ESPECIALLY HINGE-LID PACK

BACKGROUND OF THE INVENTION

The invention relates to a cigarette pack, especially a hinge-lid pack, with a pack part and a hinge lid, for receiving a cigarette group wrapped in an inner blank (tinfoil blank), the inner blank being folded around the cigarette group for the formation of a front wall, rear wall and continuous bottom wall and of side walls and end walls from folding tabs (side tabs, end tabs) partially overlapping one another.

Hinge-lid packs are a type of cigarette packaging in widespread use throughout the world. The hinge-lid pack conventionally consists of a one-part blank made of thin cardboard. Attached in the pack part is a collar which is usually obtained from a separate collar blank. This projects with an upper portion from the pack part and, in the closing position, is surrounded by the hinge-lid. The pack content, particularly the cigarette group, is wrapped in an inner blank preferably made of tinfoil. The inner blank is folded around the cigarette group to form a closed bottom wall, at the same time forming side walls and an end wall from folding tabs, particularly side tabs and end tabs, partially overlapping one another. Furthermore, the inner blank is conventionally equipped with a pull-off flap which is defined as an upper part of the front wall of the inner blank by means of a transversely directed punching line or perforation line. When the pack is to be used, the flap is removed by being pulled off or torn off, so that the upper region of the front cigarettes is exposed.

In practice, it proves difficult to extract cigarettes when the pack is completely full or almost completely full, even if the flap is removed. Because of the close packing, there are difficulties in grasping a cigarette between two fingers.

SUMMARY OF THE INVENTION

Starting from this, the object on which the invention is based is to develop further the cigarette pack mentioned in the introduction, to the effect that simple measures, especially without the incorporation of additional members, make it easier to extract the cigarettes when the pack is used.

To achieve this object, the cigarette pack according to the invention is characterized in that one part the inner blank is fixed or anchored in the pack (in the box part), in such a way that another part of the inner blank can be raised, thereby taking up (lifting) cigarettes.

Thus, according to the invention, the inner blank is used as an extraction aid, in particular as a member for lifting a number of cigarettes of the group.

Preferably, the inner blank is anchored, by means of one part of the bottom wall facing the rear wall, to the inner face of the pack, in particular to a pack bottom, for example by adhesive bonding. The remaining part of the bottom wall can therefore be lifted, specifically by pulling upwards the front wall of the inner blank. The free part of the bottom wall thereby forms a lifting part which acts on the lower ends of a number of cigarettes, in particular on a front cigarette row of the cigarette group arranged in rows. The cigarette row is thus lifted relative to the remaining cigarettes or cigarette rows of the cigarette group. As a result of this relative position, individual cigarettes of the cigarette row lifted out can be grasped and extracted from the pack. During the lifting movement, the bottom wall forms a hinge line extending in its longitudinal direction and acting as a delimitation from the (rear) part of the bottom wall anchored in the pack. During the lifting movement, the side tabs connected to the front wall are also lifted. The end tab connected to the front wall can be used as a gripping tab for lifting the front wall.

In an especially advantageous way, the lifting mechanism according to the invention for the cigarettes can be used in conjunction with a flap. According to the invention, a gripping tongue, connected to the remaining part of the front wall of the inner blank and exposed automatically when the flap is pulled off, is formed by means of an appropriately designed punching or perforation line. This gripping tongue is arranged so that it projects from the pack part or from the region surrounded by the collar, and, so that it can be used easily for lifting the remaining part of the front wall.

Further features of the invention relate to the design of the inner blank and to measures for forming the lifting-out mechanism.

An exemplary embodiment of the invention is explained in detail below by means of the drawings. In these:

DETAILED DESCRIPTION OF A PREFERRED EMBODIMENT

Figure 1:
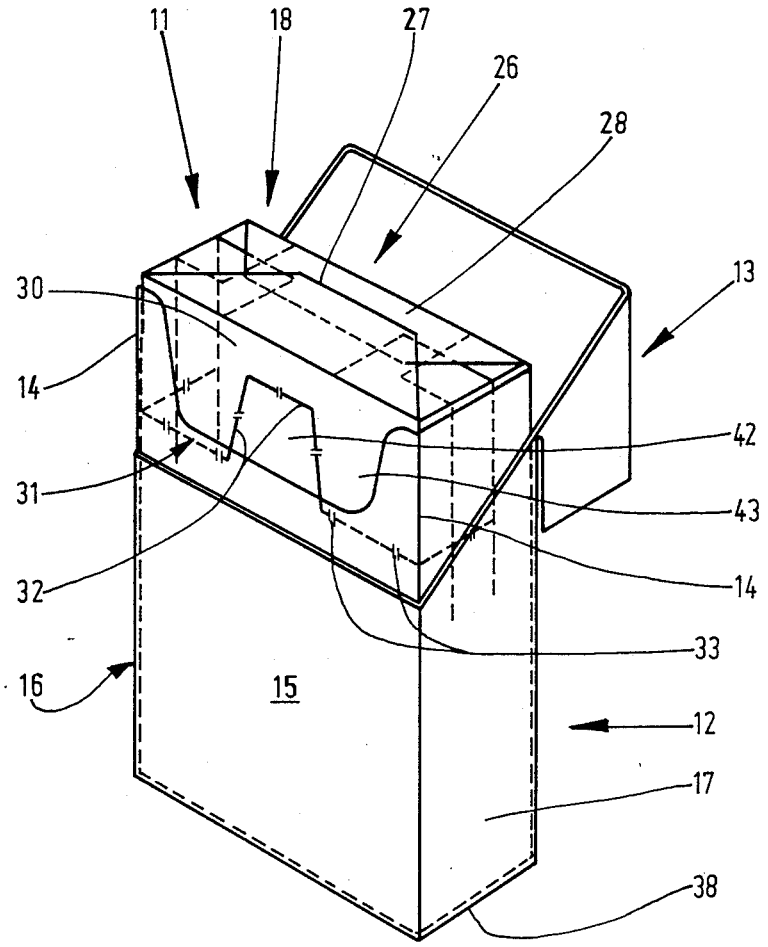
FIG. 1 shows a perspective representation of a cigarette pack of the hinge-lid type in the opened position, FIG. 2 likewise shows a perspective representation of a cigarette group wrapped in an inner blank.

Hinge-lid packs as a packaging means for cigarettes 10 or for a cigarette group 11, conventionally consist of a pack part 12 and of a hinge-lid 13 connected to this in an articulated manner. Mounted in the pack part 12 is a collar 14 which extends in the region of a pack front wall 15 and pack side walls 16 and 17. A part of the collar 14, fixed in the pack part 12 on the inside by adhesive bonding, projects from the latter. In the closing position, the projecting part of the collar 14 is surrounded by the hinge-lid 13.

The pack content, in particular the cigarette group 11, is wrapped in an inner blank 18. This conventionally consists of tinfoil. The inner blank 18 is folded around the cigarette group 11, in such a way as to form a continuous bottom wall 19 and, adjoining this, a front wall 20 and rear wall 21. Side walls 22 and 23 consist of side tabs 24 and 25 folded with a partial overlap. These are not connected to one another by adhesive bonding or otherwise. The side tabs 24 and 25 are lateral extensions of the front wall 20 and rear wall 21 respectively.

An upper end wall 26 too consists of folding tabs, in particular end tabs 27 and 28, partially overlapping one another. An upper end tab 27 is connected to the front wall 20, whilst the rear inner end tab 28 adjoins the rear wall 21. The end-wall tabs 27, 28 are also not connected to one another by adhesive bonding.

The inner blank 18 of continuously rectangular shape forms in the region of the bottom wall 19, and in the extension of or as an interconnection of the side tabs 24 and 25, bottom side tabs 29 which extend in the plane of the side wall 22, 23 on the inside when the inner blank 18 is folded.

Figure 2:
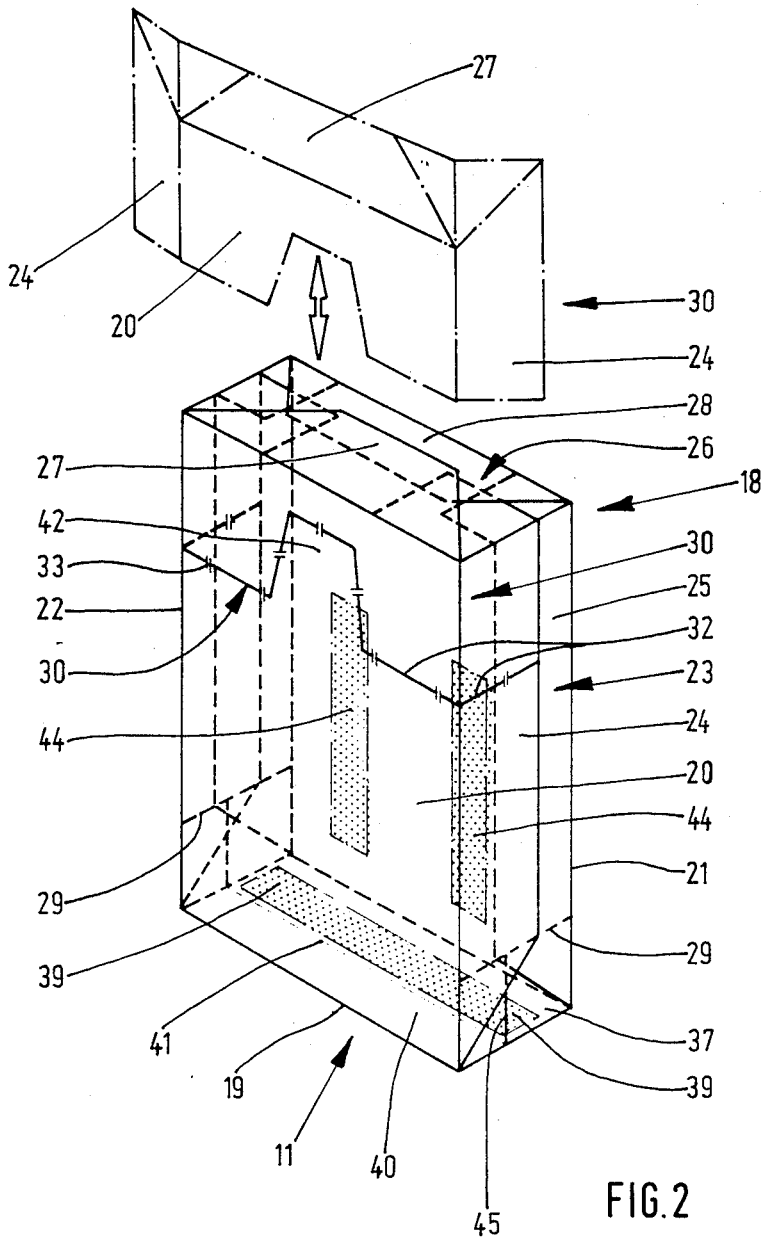
Figure 3:
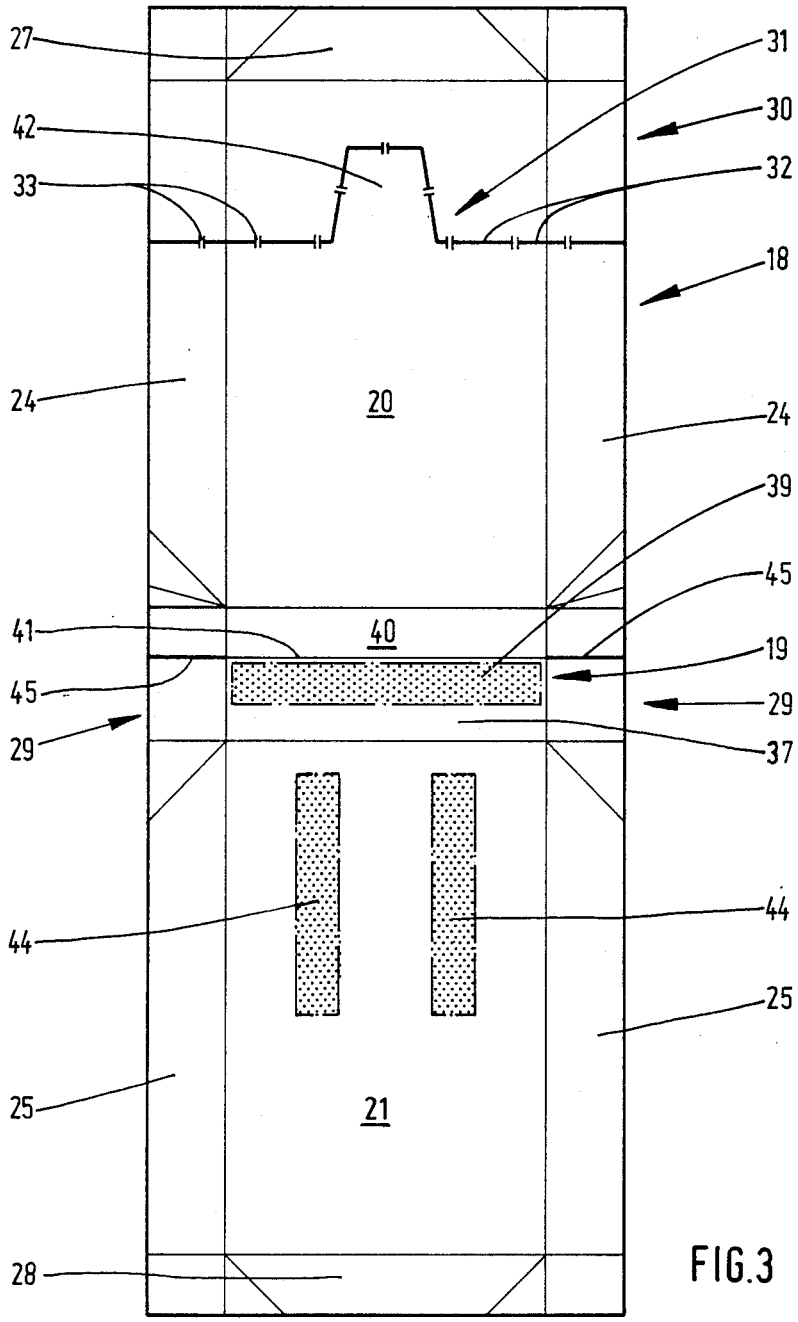
FIG. 3 shows a spread-out inner blank.

To make it easier to have access to the pack content, that is to say to the cigarettes 10, the inner blank 18 is equipped with a pull-off flap 30. This is formed by a transversely directed punching line 31 in the upper part of the front wall 20. The flap 30 also includes the outer side tabs 24, 24. For this purpose, the punching line 31 extends over the entire width of the inner blank 18. In the exemplary embodiment illustrated, the punching line 31 consists of relatively long severing cuts 32 and a few short residual connections 33. These are eliminated by tearing when the flap 30 is pulled off. In order to pull off the flap 30, the upper end tab 27 connected to the flap 30 is grasped. The flap 30, by being pulled upwards, comes away from the remaining part of the inner blank 18 (FIG. 2).

Figure 4:
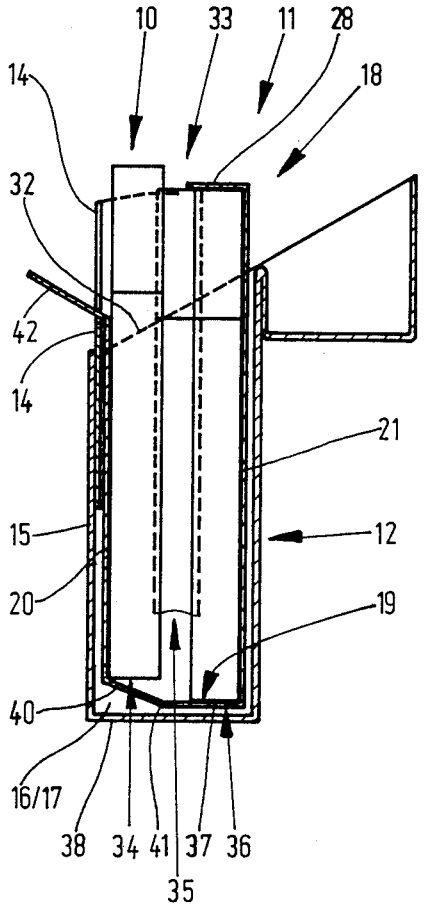
FIG. 4 shows a vertical section through a cigarette group with an inner blank in a hinge-lid pack, with some cigarettes lifted.

To make it easier to extract cigarettes 10 from the cigarette group 11, some cigarettes 10 can be lifted relative to the remaining cigarettes 10 of the cigarette group 11 as a result of a special design and arrangement of the inner blank 18. The cigarette group 11 consists of several, particularly three cigarette rows, namely a front row 34, a middle row 35 and a back row 36. One of these cigarette rows, namely the front row 34, is lifted as a whole relative to the other two rows 35, 36 for the extraction of individual cigarettes (FIG. 4).

For this purpose, part of the inner blank 18, in particular, in the present case, the front wall 20 and part of the bottom wall 19, can be lifted as a whole by being pulled up, the front row 34 of cigarettes 10 thereby being taken up, whilst the remaining part of the inner blank 18 is anchored in a suitable way in the hinge-lid pack, particularly in the pack part 12. Part of the bottom wall 19 thus acts as a lifting member.

A part of the bottom wall 19 facing the rear wall 21, particularly an anchoring part 37 slightly larger than half the area of the bottom wall 19, is connected on the inside to a pack bottom 38 of the pack part 12, especially by adhesive bonding. In the exemplary embodiment illustrated, an adhesive strip 39, extending in the longitudinal direction of the bottom wall 19 in the region of the anchoring part 37, is arranged between the bottom wall 19 and the pack bottom 38. The anchoring part 37 thus remains resting firmly on the pack bottom 38 when the remaining part of the bottom wall 19, particularly a free lifting part 40, is lifted. A hinge line 41 forms in the bottom wall 19 along the adhesive strip 39 between the lifting part 40 and the anchoring part 37.

A gripping tab 42 formed by the inner blank 18 makes it easier to actuate the front wall 20 of the inner blank 18 as a means for lifting a cigarette row. The punching line 31 delimiting the flap 30 from the remaining part of the inner blank 18 is guided in a middle region of the front wall 20, so that the gripping tab 42, pointing upwards and projecting into the region of the flap 30, is formed here. The gripping tab 42 is obtained because the punching line 31 extends upwards in the manner of an upturned V. The correspondingly shaped gripping tab 42 remains in the pack part 12 as an upwardly directed part or projection of the front wall 20 when the flap is pulled off. The arrangement is such that the essential part of the gripping tab 42 projects from the part surrounded by the collar 14 which is equipped, in the region of its front wall, with a conventional recess 43, in the region of which the gripping tab 42 is formed. The remaining part of the punching line 31 is in that part of the inner blank 18 covered by the collar 14.

When the pack is used, after the hinge-lid 13 has been opened, the upper end tab 27 assigned to the front wall 20 is grasped, and the flap 30 is pulled off by means of this end tab 27. The gripping tab 42 is thereby exposed. This can now likewise be grasped and pulled up, as a result of which that part of the front wall 20 remaining in the pack part 12 is lifted, thereby taking up the front row 34 of cigarettes 10 which is thus lifted relative to the remaining cigarettes of the pack and is ready to be grasped.

For the further fixing and securing of the inner blank 18 in the pack part 12, there are two strip-shaped vertical adhesive bonds 44 in the region of the rear wall 21. These connect the inner blank 18 to a pack rear wall of the pack part 12.

Figure 5:
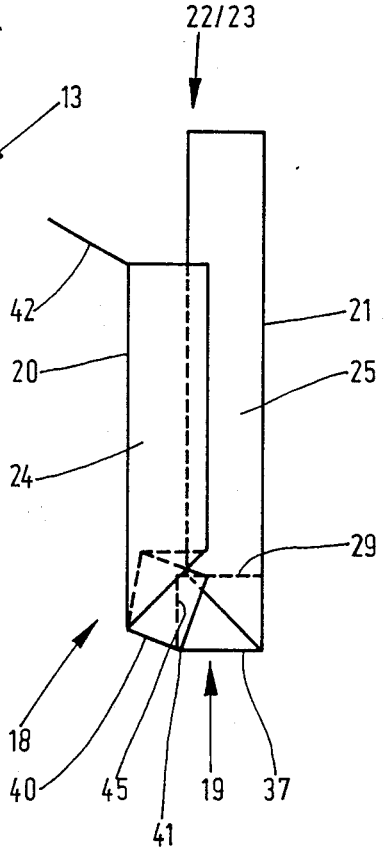
FIG. 5 shows a side view of the inner blank in a position corresponding to that of FIG. 4, without cigarettes.

A special form of the inner blank 18 guarantees to make it even easier to carry out the operation of lifting the cigarettes 10 by pulling on the gripping tab 42. In the present form of the inner blank 18, the bottom side tabs 29 adjoining the bottom wall 19 laterally are folded into a vertical position, at the same time resting against the inner face of the side walls 22, 23 or of the side tabs 24, 25 (see especially FIG. 5). To make it easier to obtain the relative movement of the front wall 20 together with the lifting part 40 for lifting out the cigarettes, the bottom side tabs 29 on both sides are given a transverse severing cut 45, specifically in the extension of the hinge line 41. It is thereby possible or easier to ensure that those regions of the bottom side tabs 29 which adjoin the lifting part 40 are also moved upwards when the front wall 20 is lifted (FIG. 5).

What is claimed is:

1. A hinge-lid cigarette pack, with an outer pack part and a hinge-lid, for receiving a cigarette group wrapped in an inner blank, the inner blank being folded around the cigarette group for the formation of a front wall, rear wall and continuous bottom wall and of side walls and end walls from folding tabs partially overlapping one another, characterized in that:

one part of the inner blank (18) is anchored in the outer pack part (12), in such a way that another part of the inner blank (18) can be lifted to lift up cigarettes (34):

the inner blank (18) has a liftable front wall (20) which remains after a flap (30) in the front wall has been pulled off and which, together with adjoinnig side tabs (24) and a lifting part (40) forming a portion of the bottom wall (19) and facing the front wall, is liftable to lift up a cigarette row (34):

said one part of the inner blank (18) is a non-liftable blank part of the bottom wall (19) and is anchored by adhesive bonding in the outer pack part (12);

said non-liftable blank part of the bottom wall (19) is an anchoring part (37) which faces the rear wall (21) of the pack, and which is anchored to a pack bottom (38) of the outer pack part (12) by adhesive bonding; and the lifting part (40) of the bottom wall (19) is delimited from the anchoring part (37) of the bottom wall (19) by a hinge line (41) extending in the longitudinal direction of the bottom wall (19).

2. Cigarette pack according to claim 1, characterized in that bottom side tabs (29) of the inner blank (18)

which adjoin the bottom wall (19) laterally have severing cuts (45) in the extension of the hinge line (41).

3. Cigarette pack according to claim 1, characterized in that the inner blank (18) is additionally anchored in the region of a rear wall (21) by means of adhesive strips (44) on a pack rear wall.

4. Cigarette pack according to claim 1, characterized in that the liftable front wall (20) of the inner blank (18), is equipped with an upwardly directed gripping tab (42) projecting from the outer pack part (12) in the unlifted position of the front wall.

5. A hinge-lid cigarette pack, with an outer pack part and a hinge-lid, for receiving a cigarette group wrapped in an inner blank, the inner blank being folded around the cigarette group for the formation of a front wall, rear wall and continuous bottom wall and of side walls and end walls from folding tabs partially overlapping one another, characterized in that:

one part of the inner blank (18) is anchored in the outer pack part (12) in such a way that another part of the inner blank (18) can be lifted to lift up cigarettes (34);

the inner blank (18) has a liftable front wall (20) which remains after a flap (30) in the front wall has been pulled off and which, together with adjoining side tabs (24) and a lifting part (40) forming a portion of the bottom wall (19) and facing the front wall, is liftable to lift up a cigarette row (34);

the liftable front wall (20) of the inner blank (18) is equipped with an upwardly directed gripping tab (42) projecting from the outer pack part (12) in the unlifted position of the front wall; and the gripping tab is an upwardly directed projection protruding into a region of the flap (30) and is limited by a punching line (31) for limiting the flap (30), in such a way that the gripping tab (24) is exposed after the flap (30) has been pulled off at an upper edge of that part of the front wall (20) remaining in the pack part (12).

* * * * *